United States Patent [19]

Rhodes

[11] 4,288,931

[45] Sep. 15, 1981

[54] METHOD AND CONVEYOR FOR SNOW REMOVAL

[76] Inventor: Glenn D. Rhodes, 4475 Dow Ridge Rd., Orchard Lake, Mich. 48033

[21] Appl. No.: 95,824

[22] Filed: Nov. 19, 1979

[51] Int. Cl.[3] ..... E01H 5/00

[52] U.S. Cl. ..... 37/10; 37/45; 198/558

[58] Field of Search ..... 198/548, 558; 37/10, 37/12, 16, 41, 45

[56] References Cited

U.S. PATENT DOCUMENTS

| | | | |
|---|---|---|---|
| 770,169 | 9/1904 | Davis | 37/12 X |
| 942,337 | 12/1909 | Moore | 37/12 X |
| 995,446 | 6/1911 | Evans, Jr. | 37/12 |
| 1,150,946 | 8/1915 | Kenlon | 37/41 |
| 1,480,652 | 1/1924 | Burris | 37/45 |
| 2,353,094 | 7/1944 | Veneziano | 37/45 |
| 2,891,655 | 6/1959 | Saiberlich | 198/548 |
| 3,485,535 | 12/1969 | Fabre | 406/61 |
| 3,602,552 | 8/1971 | Morgan | 37/10 X |
| 3,803,732 | 4/1974 | Moreno | 37/12 |
| 3,866,340 | 2/1975 | Krickovich | 37/12 |

*Primary Examiner*—Jeffrey V. Nase

*Attorney, Agent, or Firm*—Krass, Young & Schivley

[57] ABSTRACT

A method of removing snow by utilizing a conveyor unit configured to facilitate depositing of snow into a sewer system. The conveyor unit is fit on or within the manhole sewer openings from which the covers have been removed. The conveyor units comprise powered augers mounted within a snow receiving housing having hoppers from which snow is conveyed into the manhole openings. In a first version, the conveyor housing is directly received over the manhole opening, while in a second version, the hopper is offset from the manhole opening and snow is conveyed into the sewer system via a conduit extending from the hopper and into the manhole opening.

2 Claims, 4 Drawing Figures

METHOD AND CONVEYOR FOR SNOW REMOVAL

BACKGROUND DISCUSSION

This invention concerns snow removal methods and apparatus.

Snow removal in urban areas presents a formidable task for snow falls of exceptional depth or during periods when substantial accumulation from extended periods of snow fall is encountered and must be removed. The limited space on which to pile the snow after being plowed from streets and thoroughfares requires that the snow be removed entirely. Such removal is generally and most commonly done by loading the snow into trucks which transport the snow to distant dumping sites, as into rivers or available surrounding land areas. Clearly, such approach requires enormous expenditures for the trucking of massive volumes of snow, such trucking congesting the traffic arteries and necessitating relatively extensive time periods in order to effect snow clearance.

Such ineffectiveness can exact an enormous toll from the economy of an urban area which has sustained snow fall sufficient to impede for significant periods the normal flow of traffic within the city and nearby areas such as airports, etc.

It has heretofore been realized and proposed that the sewage system of a city could be utilized to enable removal of snow by depositing the snow in the sewer system.

Such method is described in U.S. Pat. Nos. 1,150,946 (Kenlon) and 995,446 (Evans, Jr.). These patents describe relatively elaborate and somewhat impractical means for getting the snow into the sewer system, i.e., the creation of slurry by means of high pressure water received from the water mains, which does not appear feasible for the handling of large volumes of snow, and could create further problems in periods of very cold weather.

It has also been proposed to melt the snow and dump the resultant water into the sewer system as described in U.S. Pat. No. 3,803,732 (Moreno).

Such snow removal method has not received wide acceptance due to the cost and impracticality of handling the volumes of snow which sometimes must be handled in northern cities; and also, this method requires a great deal of energy to achieve snow melting, which is undesirable due to the cost of any process requiring the use of heat energy, particularly in view of the recent scarcity and cost of energy.

The volume of water flowing through the municipal sewer system represents a potential source of energy and also a potential means of transport for both melting the snow and removing it from the city streets.

It is therefore an object of the present invention to provide a simplified method and apparatus for utilizing the sewer system as a means of removing snow from urban surface areas which does not require the melting of snow prior to its deposit into the sewer system and which involves relatively low cost, simple equipment which is capable of handling great volumes of snow.

It is another object of the present invention to provide a snow removal method and apparatus in which the effort required in transporting the snow from the site where it is to be removed is reduced to an absolute minimum expenditure in terms of energy and equipment, and which facilitates the snow removal process such as to enable expeditious clearing of the traffic arteries, particularly in congested urban areas.

SUMMARY OF THE INVENTION

These and other objects of the present invention, which will become apparent upon a reading of the following specification and claims, are achieved by providing specially configured conveyor devices which are adapted to be fit on or within open manholes entering into the sewer system, such that the snow may be directly deposited at the manhole openings after implacement of the conveyor units to cause rapid movement of the cleared snow into the sewer mains.

In a first version, the conveyor unit is adapted to be mounted directly above the manhole opening, with a hopper receiving loaded snow which is conveyed rapidly down through the opening and into the sewer system.

In a second version, the conveyor unit is disposed to one side of the manhole opening and provided with a hopper adapted to receive snow dumped therein as from front end loaders, and is conveyed through a connected conduit into the manhole opening sewer main.

In both versions, the conveyor unit comprises an auger mounted so as to be driven within a conveyor housing including a hopper section, with an auger rotated by suitable motive power such as an electric drive motor or alternatively gasoline or diesel powered engines.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

The present invention fundamentally resides in enabling the rapid movement of large volumes of cleared snow into a municipal sewer system by facilitating the movement of snow into manhole openings providing entrance to the sewer mains.

This is realized by specially configured conveyor units which are adapted to be fit into the manhole openings after removal of the manhole covers.

Figure 1:
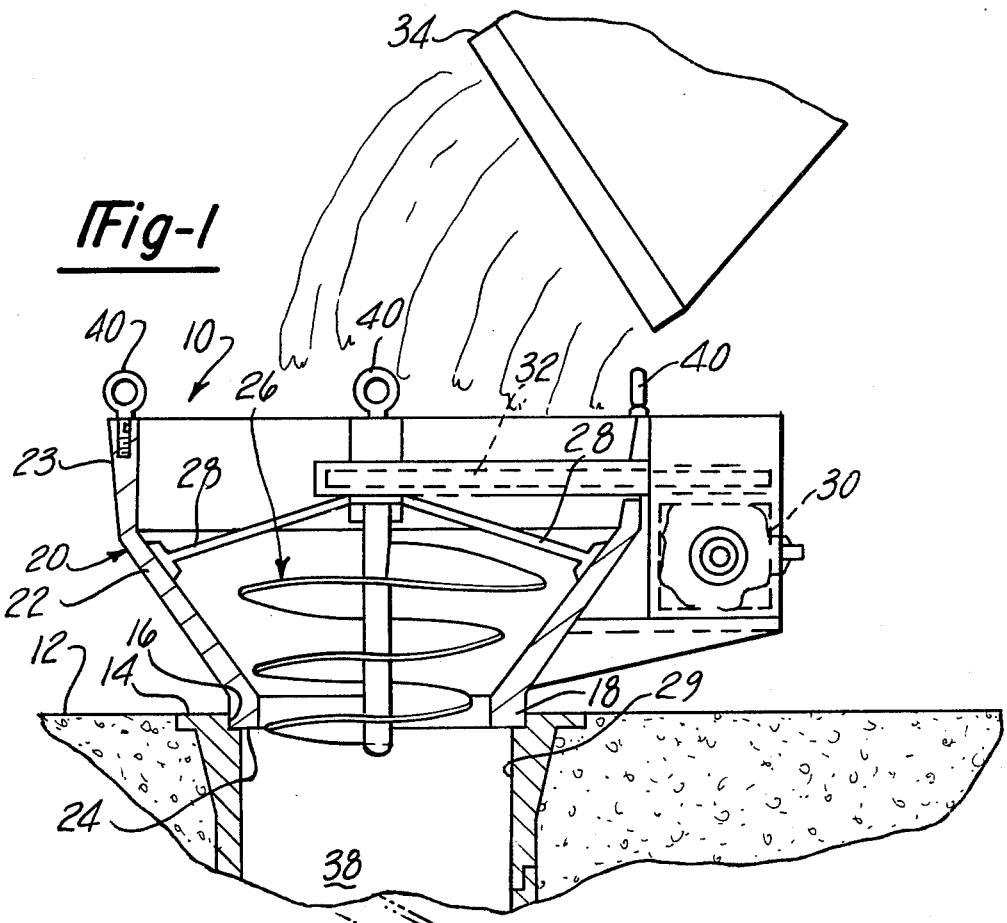
FIG. 1 is a side elevational section taken through a manhole opening and connected sewer line with a conveyor unit according to the present invention disposed in the opening.

One embodiment of such a conveyor unit is depicted in FIG. 1 in which the conveyor unit 10 is mounted above the street surface 12. The manhole fitting 14 is normally provided with a recess 16 into which the manhole cover is received. Such recess in this embodiment receives a flange 18 which is formed on a conveyor housing 20. The conveyor housing 20 is generally conical and has an upward flaring section 22 with an upper flared hopper section 23. The conveyor housing 20 also includes a generally cylindrical body portion 24 received within or above the manhole opening 29. Within the housing 20 is mounted a revolvable conveyor element comprised of an auger 26, which is rotatably mounted on a supporting cross member 28.

The auger 26 is driven by a suitable motor means such as the electric motor 30 depicted in FIG. 1 and a chain belt or gear drive 32.

The snow is thus dumped as by the loader bucket indicated at 34 into the flaring opening defined by the upward flaring hopper 23 and thence channeled into the opening of the cylindrical body portion 24, through which it is rapidly moved by rotation of the auger 26 conveying the snow quickly downwardly through the interior of the cylindrical body portion 24 and thence into the interior of the sewer fitting 38 which communicates with sewer mains (not shown).

Suitable lifting eye openings 40 are preferably provided to enable ready hoisting of the unit into position after removal of the manhole cover.

Accordingly, the snow may be rapidly plowed into piles, thence conveyed into the sewer mains as rapidly as the snow may be loaded into the conveyor unit 10.

Figure 2:
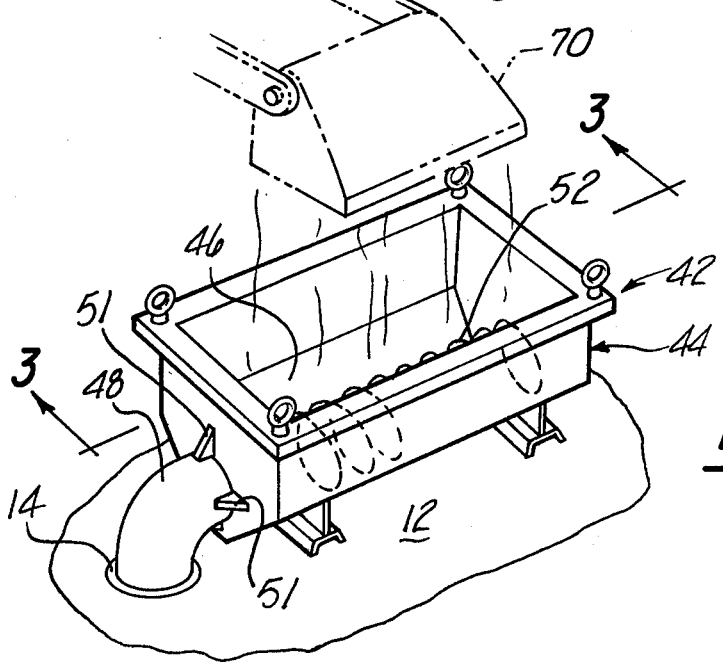
FIG. 2 is a perspective view of an alternate embodiment of an installed conveyor unit shown according to the present invention showing a fragmentary view of a front end loader depositing snow therein.
Figure 3:
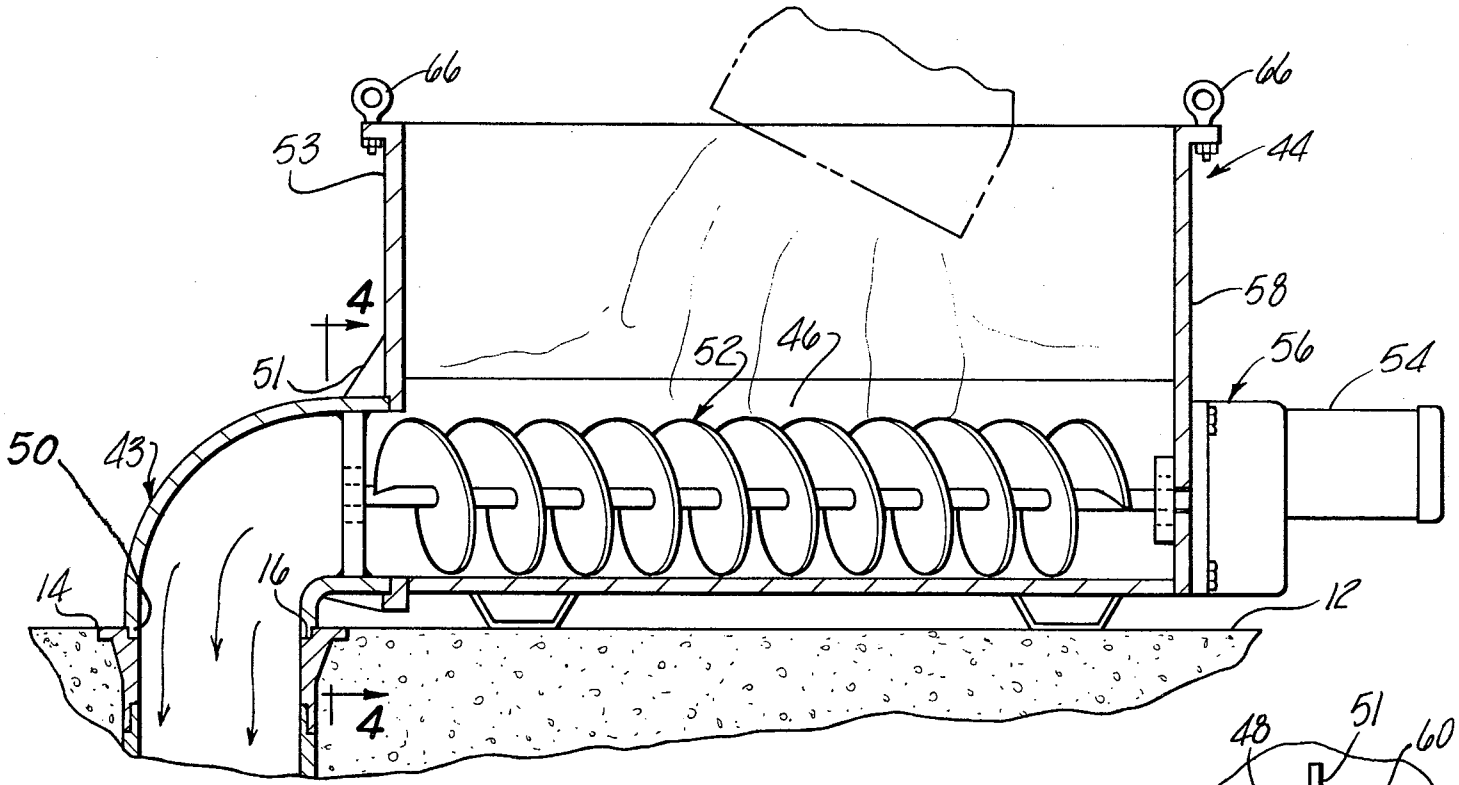
FIG. 3 is a side elevational section of the manhole opening in which is installed the alternate embodiment of the conveyor unit depicted in FIG. 2.
Figure 4:
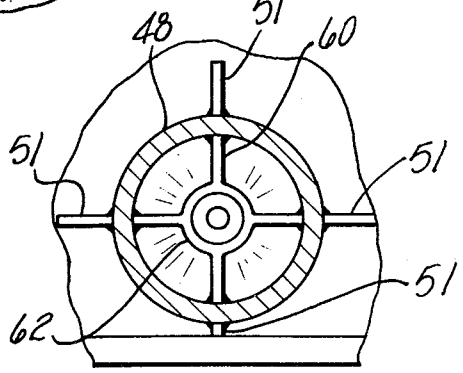
FIG. 4 is a view of the section 4—4 taken in FIG. 3.

An alternate version is shown in FIGS. 2 through 4 in which the receiving hopper rather than being mounted directly above the manhole opening is mounted to one side. In this case, the conveyor unit 42 includes a generally prismatically shaped hopper-housing 44 which has a lower converging section 46 to provide a funnel-like hopper disposed above the street surface 12.

Extending from one end of the hopper-housing 44 is a 90° elbow conduit section 48 which has an end portion which is configured to just fit over or into the manhole fitting 14 with a shoulder 50 providing a seating on the recess 16 formed in the manhole fitting 14. Webs 51 are welded to an endwall 53 to support the conduit 48.

Adapted to be rotated within the bottom of the hopper-housing 44 is an auger 52, as provided in the above-described embodiment with a drive system including a drive motor 54 driving the auger 52 via a gear set 56. Drive motor 54 is supported on an endwall 58 of hopper-housing 44.

The auger 52 is supported centrally within the interior of the section 46 by a series of support arms 60 and 62 and a shaft support mounted within the conduit 48.

A series of lifting eyes 66 are provided secured to the upper edge of the hopper-housing 44 to facilitate the implacement of the conveyor into the manhole opening.

As above noted, a front end loader bucket 70 may be employed to dump snow into the hopper and thence to be rapidly conveyed into the interior of the sewer opening via conduit 48.

Accordingly, according to the methodology of the present invention and utilizing the special purpose conveyor unit, vast volumes of snow may be removed from the collection sites, with little or no trucking required since it merely need be deposited through any of the numerous manhole openings present in most urban sewer systems; and, thence, being rapidly moved into the sewer mains themselves where the melting of the snow and the movement of sewage water eliminates the snow.

The concept of the present invention constitutes an extremely expeditious method of enabling those charged with the task of removing snow to remain abreast of unusually heavy snow falls or sustain abnormally heavy snow falls over extended periods. This is achieved without the use of heavy capital investment inasmuch as the conveyor units themselves are relatively simple and trouble free in operation such as to enable realization of the benefits of the present invention at relatively modest cost.

The embodiments of the invention in which an exclusive property or privilege is claimed are defined as follows:

1. Apparatus for removing snow comprising means for moving snow into a sewer manhole opening, said means including:

(a) an open ended hopper for receiving snow deposited therein, said hopper having an outlet adapted to be fit within said sewer manhole opening;

(b) an auger conveyor means within the hopper extending at least to the proximity of the outlet adapted to move snow in substantially its deposited form through the hopper and into said sewer manhole opening; and (c) a motive power means for operating said auger conveyor means whereby snow is rapidly transferred to the sewer manhole opening without requiring a change of state of the snow.

2. The apparatus of claim 1 wherein said auger conveyor means is vertically oriented in said hopper.

* * * * *